US005328441A

United States Patent [19]

Carr

[11] Patent Number: 5,328,441

[45] Date of Patent: Jul. 12, 1994

[54] IMPERFORATE BOWL CENTRIFUGAL SEPARATOR WITH SOLIDS GATE

[75] Inventor: Robert B. Carr, Dedham, Mass.

[73] Assignee: Carr Engineering Associates, Inc., Easton, Mass.

[21] Appl. No.: 95,034

[22] Filed: Jul. 20, 1993

Related U.S. Application Data

[63] Continuation of Ser. No. 803,475, Dec. 4, 1991, abandoned.

[51] Int. Cl.[5] ..... B04B 11/08; B04B 9/12

[52] U.S. Cl. ..... 494/58; 494/46; 494/56; 494/62; 210/372; 210/375

[58] Field of Search ..... 210/360.1, 369, 380.1, 210/396, 372, 374, 375, 376, 368; 494/2, 42, 43, 48, 56–59, 46, 62

[56] References Cited

U.S. PATENT DOCUMENTS

| | | | |
|---|---|---|---|
| 302,612 | 7/1884 | Weston | 210/372 X |
| 909,188 | 5/1933 | Roberts | 210/376 X |
| 1,903,298 | 4/1933 | Roberts | 210/376 X |
| 1,940,812 | 12/1933 | Roberts | 210/376 X |
| 2,622,795 | 12/1952 | Baxter, Jr. | 494/2 |
| 2,894,634 | 7/1959 | Lepoutre et al. | 210/376 X |
| 2,932,401 | 4/1960 | Tholl | 210/369 |
| 3,056,505 | 10/1962 | Andersson | 494/56 X |
| 3,092,579 | 6/1963 | Moretti | 210/380.1 X |
| 3,294,317 | 12/1966 | Moretti | 494/56 X |
| 3,961,746 | 6/1976 | Werner | 494/26 |
| 4,784,634 | 11/1988 | Schiele | 494/2 |

FOREIGN PATENT DOCUMENTS

| | | | |
|---|---|---|---|
| 8000421 | 3/1980 | World Int. Prop. O. | 494/2 |

*Primary Examiner*—Timothy F. Simone
*Assistant Examiner*—Charles Cooley
*Attorney, Agent, or Firm*—Darby & Darby

[57] ABSTRACT

An imperforate bowl centrifugal separator includes an imperforate separator bowl; a housing for rotatably mounting the bowl including a chamber in which the bowl rotates; an outlet for removing the centrate from the chamber; a discharge port in the housing for removing solids from the bowl; and a gate for closing the discharge port during extraction of centrate from the chamber and opening the discharge port to remove the solids after substantially all of the centrate has been removed from the chamber. The solids and centrate are removed from the same outlet in the bottom of the bowl.

5 Claims, 6 Drawing Sheets

IMPERFORATE BOWL CENTRIFUGAL SEPARATOR WITH SOLIDS GATE

This is a continuation of application Ser. No. 07/803,475, filed Dec. 4, 1991 now abandoned.

FIELD OF INVENTION

This invention relates to an imperforate bowl centrifugal separator, and more particularly to such a centrifugal separator having a gating device that prevents centrate from entering the solids discharge port.

BACKGROUND OF INVENTION

Imperforate bowl centrifugal separators generally employ a skimmer pipe to remove the remaining liquid at the end of a separation cycle prior to the solids discharge. This method of liquid removal suffers a number of problems. The boundary between the liquid and solids is unknown and variable so that it is difficult to remove all the liquid without removing some solids and contaminating the liquid with those solids. In addition the skimmer pipe can become plugged, is subject to high abrasion and wear from the solids, and can be damaged by excessive contact with the solids. To avoid these problems skimming is arrested short of contacting the solids but this leaves some liquid in the bowl which then contaminates the solids being discharged. A separate problem that occurs in such centrifuges is that centrate sprays or splashes out of the bowl during the separation cycle and falls into the solids collector where it contaminates the discharged solids.

SUMMARY OF INVENTION

It is therefore an object of this invention to provide an improved imperforate bowl centrifuge which enables total drainage of the residual liquid.

It is a further object of this invention to provide such an improved imperforate bowl centrifuge which enables recovery of solids free of liquid contamination.

It is a further object of this invention to provide such an improved imperforate bowl centrifuge which eliminates the need for a skimmer pipe with its attendant expense and complexity.

It is a further object of this invention to provide such an improved imperforate bowl centrifuge which prevents contamination of previously discharged solids by centrate splashing or spraying out of the bowl during the separation cycle.

The invention results from the realization that a truly effective imperforate bowl centrifugal separator which eliminates the need for a skimmer, provides cleaner centrate and prevents contamination of discharged solids can be achieved with a gating device that seals the solid discharge port during separation and opens it for solids discharge only after the centrate has been drained.

This invention features an imperforate bowl centrifugal separator including an imperforate separator bowl and a housing for rotatably mounting the bowl and including a chamber in which the bowl rotates. There are means for removing the centrate from the chamber and there is a discharge port in the housing for removing solids from the bowl. Gate means close the discharge port during extraction of centrate from the chamber and open the discharge port to remove the solids afterward.

In a preferred embodiment the gate means may be mounted to the chamber and housing. It may be mounted for rotational or translational movement relative to the housing.

DISCLOSURE OF PREFERRED EMBODIMENT

Other objects, features and advantages will occur to those skilled in the art from the following description of a preferred embodiment and the accompanying drawings, in which.

The invention may be accomplished in an imperforate bowl centrifugal separator employing a bowl and a housing which rotatably mounts the bowl and includes a chamber in which the bowl rotates. The housing includes an outlet for draining the centrate from the chamber in the separation process and there is a port in the housing through which the solids can be discharged from the bowl. A gate closes the solids discharge port during the separation cycle while the centrate is being drained to prevent any leakage of the centrate into the solids discharge collector. After the feed is stopped and the bowl has stopped rotating and the centrate has been given an opportunity to drain from the bowl, the gate is opened to permit solids that are removed by the scraper blade to discharge into the solids collector. The gate is mounted on the housing and may be configured for rotational or translational motion relative to the housing to open and close the discharge port.

Figure 1:
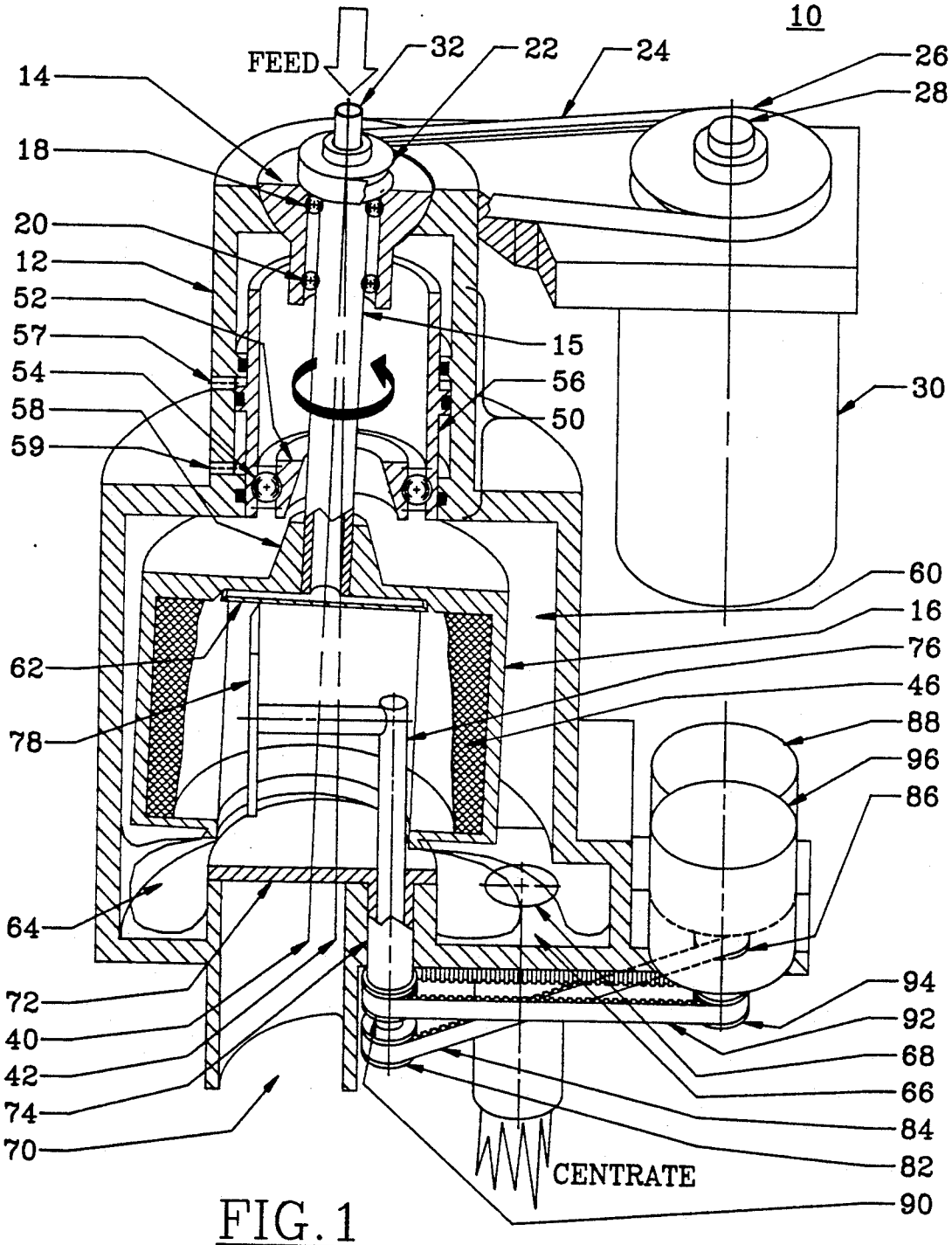
FIG. 1 is a schematic diagram in cross-section of an imperforate bowl centrifugal separator operating in the feed mode and including a pivoting solids discharge gate according to this invention.

There is shown in FIG. 1 a centrifugal separator 10 including a housing 12 which carries a spherical bearing 14. Bowl 16 including hollow spindle 15 is mounted for rotation in spherical bearing 14 by means of bearings 18 and 20. Spindle 15 is rotated at high speed by pulley 22 driven by belt 24 which in turn is driven by pulley 26 on shaft 28 of motor 30. Feed is delivered through inlet pipe 32 and through the channel in hollow spindle 15 to bowl 16. Spherical bearing 14 flexibly pendulously supports spindle 15 and bowl 16 so that bowl 16 may be rotated at high speeds, even above spindle critical speeds. Such high speeds are attainable because spherical bearing 14 permits the rotation axis 40 to deviate from the vertical axis 42 in order to accommodate unbalanced loads in bowl 16.

In order to permit spindle 15 to rotate about axis 40 divergent from axis 42 and accommodate unbalanced loads, and yet provide the necessary rigidity for bowl 16 when the scraper blade 78 is applied to remove the solids 46 from the inside of bowl 16, a locking bearing 50 has been provided. Locking bearing 50 includes a conical surface 52 rotatably connected by a bearing 54 to slidable locking cylinder 56. When cylinder 56 is held in the retracted position by air or hydraulic pressure through port 59, as shown in FIG. 1, there is enough space between the conical journal 58 mounted on spindle 15, and the conical surface 52 of locking bearing 50 to permit spindle 15 and bowl axis 40 to swing off the axis of rotation 42. After the high-speed separation portion of the cycle is over, however, cylinder 56 can be slid downwardly by air or hydraulic pressure through port 57 so that conical surface 52 engages conical journal 58 and aligns the bowl and spindle axis 40 with the rotational axis 42 yet permits rotation at slow speed of bowl 16 so that the scraper blade 78 can effect the removal of the solids. The operation of locking bearing 50 is explained in greater detail in a copending application entitled "Centrifugal Separator With Flexibly Suspended Restrainable Bowl" by Robert B. Carr, filed on even date herewith, and incorporated herein by reference.

The lower portion of housing 12 includes chamber 60 in which bowl 16 rotates. Bowl 16 includes a deflector plate 62 for directing the feed descending through spindle 15 toward the circumference of bowl 16. At the lower portion of chamber 60 is an annular trough 64 in which the centrate collects before it is delivered to centrate pool 66, from which the centrate exits through outlet 68. Chamber 60 also includes a solids discharge port 70 which is sealed by rotary gate plate 72. Gate 72 includes a vertical collar 74 rotatably mounted about shaft 76 which carries scraper blade 78. Shaft 76 is driven by pulley 82 interconnected by belt 84 with pulley 86 driven by motor 88. Collar 74 is fixed to pulley 90 which is driven by belt 92 interconnected with pulley 94 driven by motor 96.

During the feed cycle shown in FIG. 1, the solids 46 collect along the inner circumference of bowl 16 while the centrate flows into pool 66 and beyond through outlet 68. Gate 72 is closed to sealingly engage port 70 during this time and scraper blade 78 is swung out of contact with the solids 46.

Figure 2:
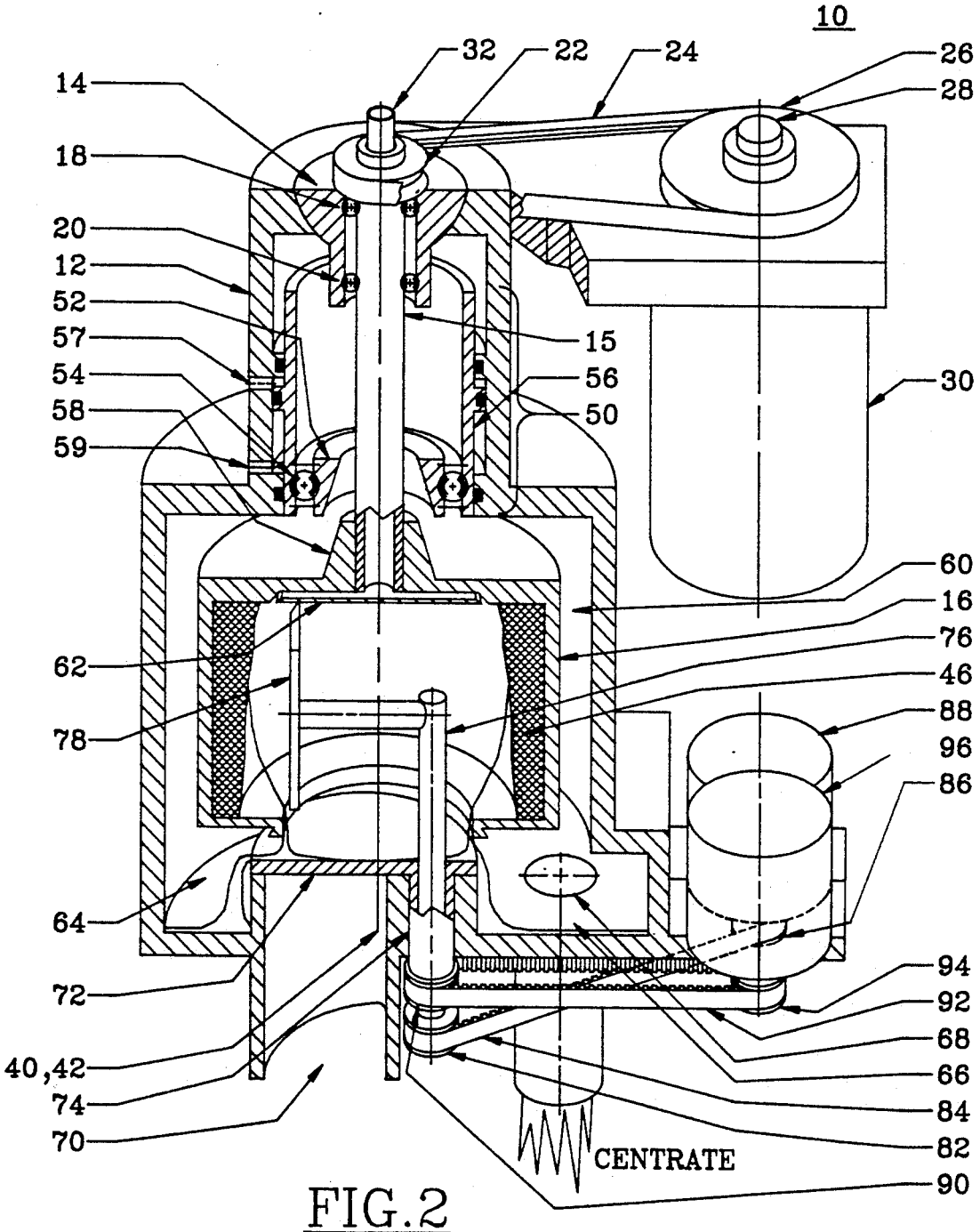
FIG. 2 is a view similar to FIG. 1 with the separator operating in the drain mode.

During the drain cycle, shown in FIG. 2, bowl 16 is braked to a stop so that any residual centrate can drain off into trough 64 and pool 66, and beyond through outlet 68.

Figure 3:
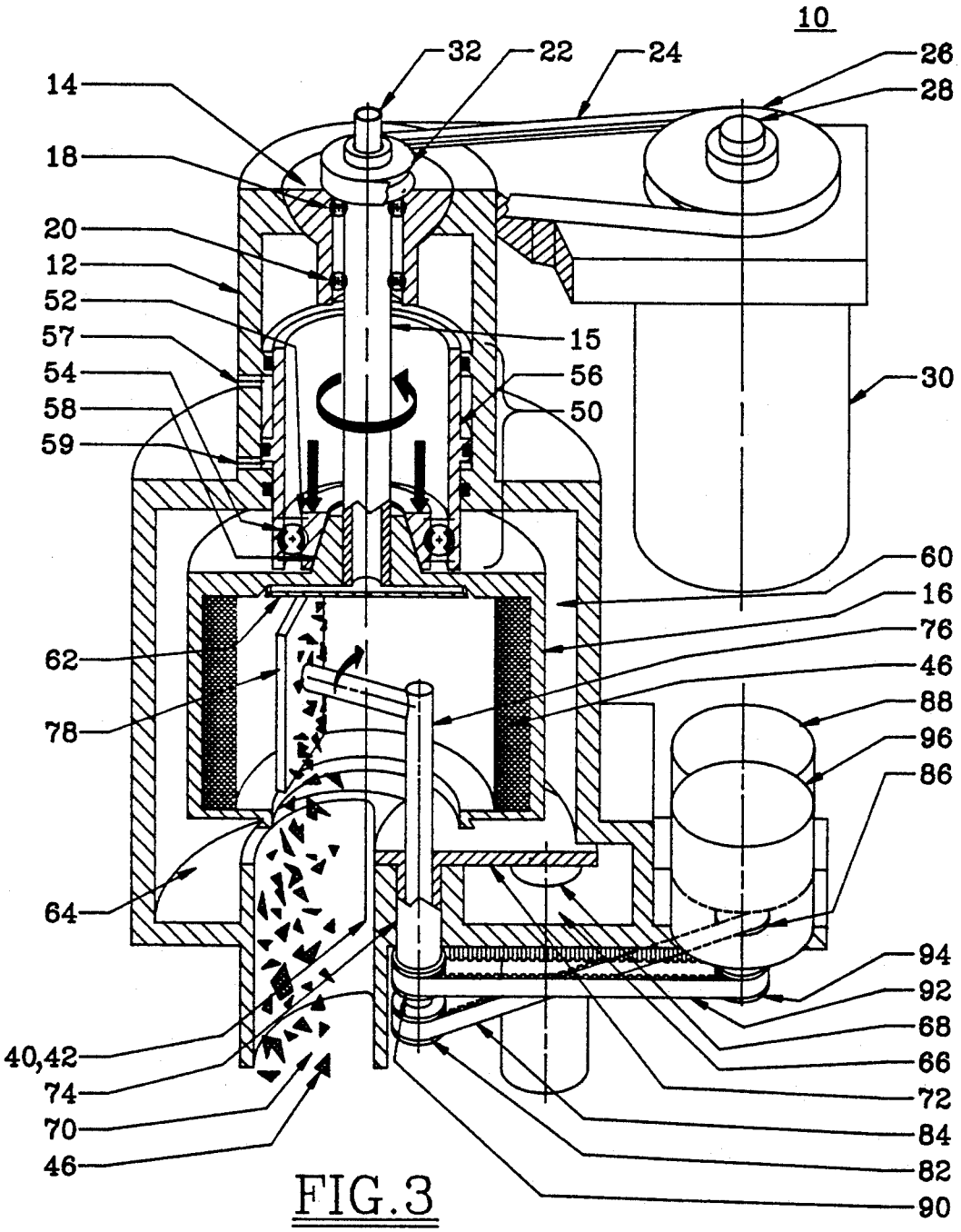
FIG. 3 is a view similar to FIGS. 1 and 2 with the separator operating in the discharge mode with the gate open.

Following this, during the discharge cycle, FIG. 3, motor 88 is actuated to drive pulleys 86 and 82, thereby swinging scraper blade 78 into the solids which have been collected on the inner circumference of bowl 16. Motor 96 operates pulley 94, and thus pulley 90, to rotate collar 74 and with it gate 72 so that it now swings out of the way opening discharge port 70 and permitting the dry solids to be discharged as they are scraped loose by scraper blades. At this time sliding cylinder 56 has been moved downwardly by air or hydraulic pressure through port 57 so that locking bearing 50 is fully engaged and radial motion of spindle 15 and bowl 16 can no longer be effected. Since the scraping action occurs at low speed below the critical speeds, the lack of accommodation for unbalanced loads is no longer essential.

Figure 4:
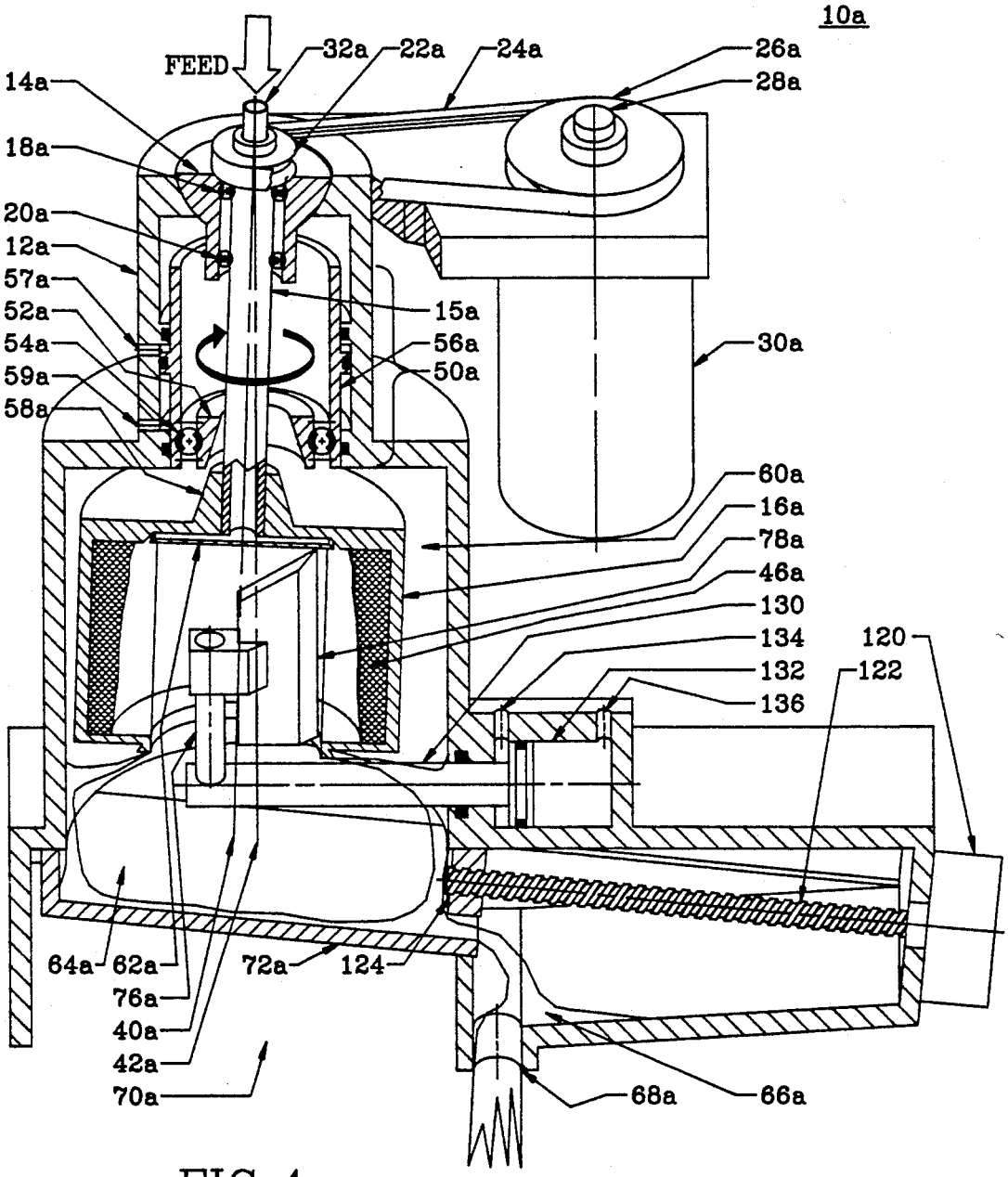
FIG. 4 is a schematic diagram in cross-section of an imperforate bowl centrifugal separator operating in the feed mode and including a translational solids discharge gate according to this invention.
Figure 5:
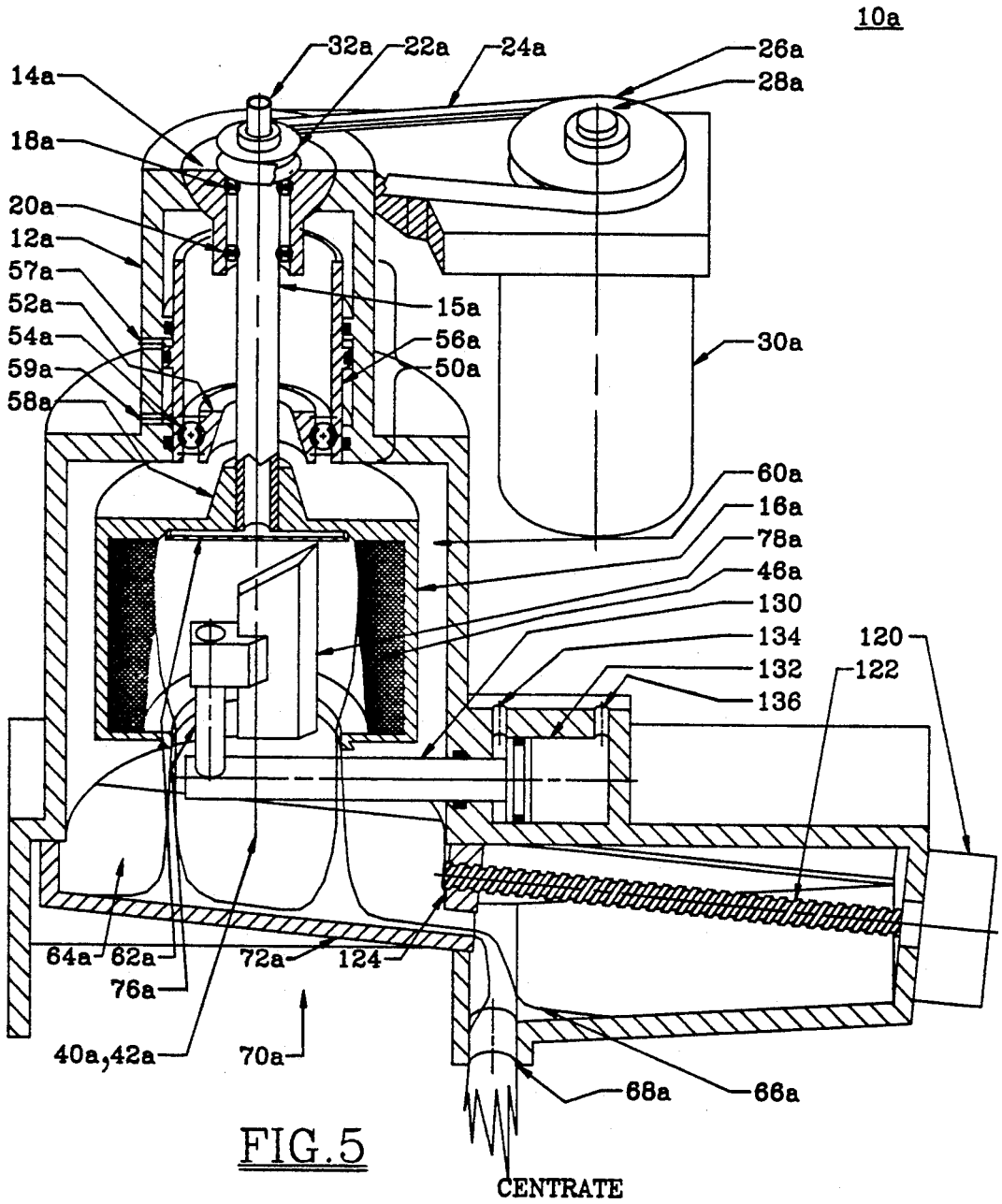
FIG. 5 is a view similar to FIG. 4 with the separator operating in the drain mode.
Figure 6:
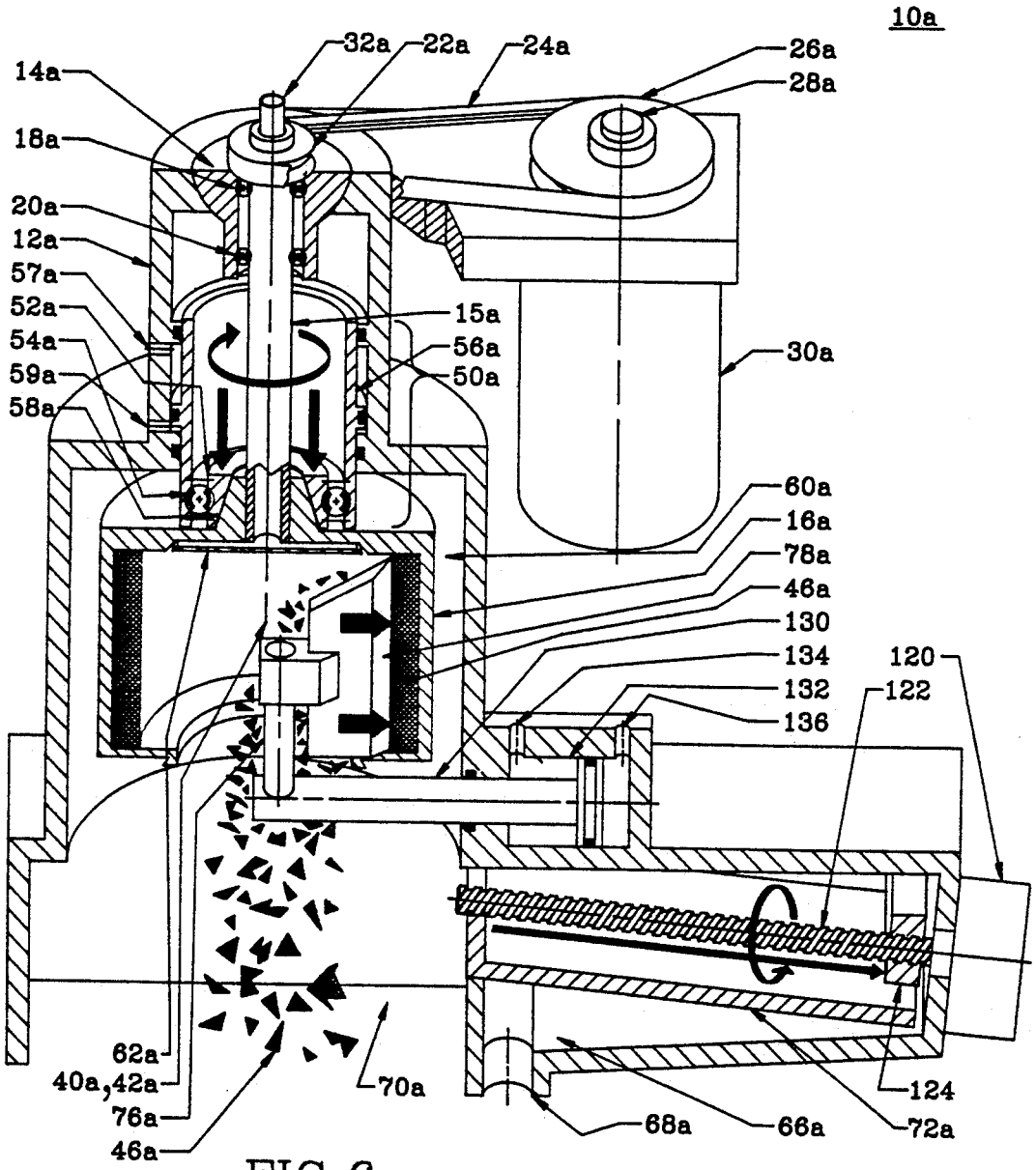
FIG. 6 is a view similar to FIGS. 4 and 5 with the separator operating in the discharge mode with the gate open.

Although thus far gate 72 is shown as a rotary device, this is not a necessary limitation of the invention. For example as shown in FIGS. 4, 5 and 6, gate **72*a* which closes port 70*a* may be a translationally operated device: that is, it may slide to and fro rather than rotate to and fro to open and close discharge port 70*a*. Spindle 15*a*, spherical bearing 14*a*, locking bearing 50*a*, bowl 16*a*, and the various other components may be the same in FIGS. 4, 5 and 6 as in FIGS. 1, 2 and 3. However, translational or sliding gate 72*a* is interconnected with motor 120 by means of a lead screw 122 and lead screw block 124. Shaft 76*a*, which carries scraper blade 78*a*, likewise does not rotate in the embodiments of FIGS. 4, 5 and 6. Rather, it is drawn toward and away from the inner circumferential wall of bowl 16*a* by means of piston rod 130 which is extended and retracted by cylinder 132. In FIG. 4, piston rod 130 is fully extended to keep scraper blade 78*a* clear of the solids 46*a* collecting on the inner circumference of bowl 16*a* during the feed cycle. At this time gate 72*a* is fully closed so that the centrate separated from the feed coming from spindle 15*a* can be gathered in the area 64*a* and delivered to pool 66*a* from whence it will be further delivered through outlet 68*a***.

In the drain cycle as shown in FIG. 5, the bowl **16*a* and spindle 15*a* have been slowed to a stop by motor 30*a* and gate 72*a* and the scraper blade 78*a* remain in the same position while the residual centrate drains off into areas 64*a* and then into pool 66*a* before it exits through outlet 68*a*. However, during the discharge cycle in FIG. 6, motor 120 has been actuated to drive lead screw 122 and draw lead block 124 along with gate 72*a* all the way back into the retracted position in pool 66*a*. This opens the solids discharge port 70*a* so that the scraped solids can fall out, free from contamination by any residual liquid. At this point cylinder 132 has been actuated to retract piston rod 130 and pull scraper blade 78*a* into the solids 46*a* collected on the inner circumference of bowl 16*a***.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An imperforate centrifugal separator for separating a feed material into centrate and solids, comprising:

an imperforate separator bowl having an inlet for the feed material and an outlet for the centrate and solids;

a stationary housing for rotatably mounting said bowl, said housing having a chamber surrounding said bowl;

a discharge port in said housing for allowing solids that are transferred from said bowl to said chamber to exit from said housing;

said centrate being transferred from said bowl to said chamber through said outlet;

means for transferring said solids from said bowl to said discharge port through said outlet;

means for removing said centrate transferred from said outlet from said chamber; and a gate mechanism mounted to said housing having a closed position for closing said discharge port during removal of said centrate from said chamber and having an open position for opening said discharge port after substantially all of said centrate has been removed from said chamber to allow removal of said solids.

2. The imperforate bowl centrifugal separator of claim 1 in which said gate mechanism is located in said chamber.

3. The imperforate bowl centrifugal separator of claim 1 in which said gate mechanism is rotatably mounted to said housing for rotating between the closed and open positions.

4. The imperforate bowl centrifugal separator of claim 1 in which said gate mechanism is translationally mounted to said housing for sliding between the closed and open positions.

5. The imperforate bowl centrifugal separator of claim 1 in which said outlet is in the bottom of said separator bowl.

* * * * *